US008621384B2

(12) United States Patent
Nagai

(10) Patent No.: US 8,621,384 B2
(45) Date of Patent: Dec. 31, 2013

(54) INFORMATION DELIVERY SERVICE SYSTEM, IN-TRAIN INFORMATION DELIVERY METHOD, AND IN-TRAIN INFORMATION DISPLAY APPARATUS

(75) Inventor: Norie Nagai, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 250 days.

(21) Appl. No.: 13/055,975

(22) PCT Filed: Mar. 3, 2009

(86) PCT No.: PCT/JP2009/053984

§ 371 (c)(1),
(2), (4) Date: Jan. 26, 2011

(87) PCT Pub. No.: WO2010/013507

PCT Pub. Date: Feb. 4, 2010

(65) Prior Publication Data

US 2011/0131522 A1 Jun. 2, 2011

(30) Foreign Application Priority Data

Jul. 29, 2008 (JP) ..... 2008-195506

(51) Int. Cl.
*G06F 3/00* (2006.01)

(52) U.S. Cl.
USPC ..... 715/781; 715/700; 715/764; 701/1; 701/19

(58) Field of Classification Search
USPC ..... 715/700, 733, 764, 765, 781; 701/1, 19
See application file for complete search history.

(56) References Cited

U.S. PATENT DOCUMENTS

| | | | | |
|---|---|---|---|---|
| 6,570,580 | B1 * | 5/2003 | Suzuki et al. | 345/629 |
| 2002/0194759 | A1 * | 12/2002 | Badaracco et al. | 40/453 |
| 2005/0249383 | A1 * | 11/2005 | Maritzen et al. | 382/115 |
| 2007/0130599 | A1 * | 6/2007 | Monroe | 725/105 |
| 2008/0195257 | A1 * | 8/2008 | Rauch | 701/1 |

FOREIGN PATENT DOCUMENTS

| | | | | |
|---|---|---|---|---|
| CN | 2870054 | Y | 2/2007 | |
| JP | 5-058287 | A | 3/1993 | |
| JP | 05-319267 | A | 12/1993 | |
| JP | 2002109110 | * | 4/2002 | G06F 17/60 |

(Continued)

OTHER PUBLICATIONS

Hitoshi Furukabou, "Advertisement Synchronization System", English Internet Translation of JP-2005031476, Feb. 3, 2005, 35 pages.*

(Continued)

*Primary Examiner* — Xiomar L Bautista
(74) *Attorney, Agent, or Firm* — Buchanan Ingersoll & Rooney PC

(57) ABSTRACT

To obtain an information delivery service system, an in-train information delivery method, and an in-train information display apparatus that can deliver many pieces of information simultaneously. In an information delivery service system applied to a passenger train to display an image for delivering information to passengers, an in-train information display apparatus that groups a plurality of windows of the passenger train and uses the grouped windows as one display area, and a display information processor that outputs image information to the in-train information display apparatus are provided, thereby displaying an image on a horizontally long and large screen.

10 Claims, 6 Drawing Sheets

(56) References Cited

FOREIGN PATENT DOCUMENTS

| | | | | | |
|---|---|---|---|---|---|
| JP | 2004-037728 | A | | 2/2004 | |
| JP | 2004-070254 | A | | 3/2004 | |
| JP | 2005031476 | A | * | 2/2005 | ..... G09F 21/04 |
| JP | 2005271691 | | * | 10/2005 | ..... B61L 25/02 |
| JP | 3875950 | B2 | | 1/2007 | |
| JP | 2007-283991 | A | | 11/2007 | |
| JP | 2008-171324 | A | | 7/2008 | |

OTHER PUBLICATIONS

Machine translation for JP05058287, Mar. 9, 1993.*

Evan Yares, "Video walls shows big picture—at a big price", Jan. 20, 1992, PC Week, v9, n3, p. 73(1).*

News Advisory, "Trailer Train exhibit to feature video wall", Jun. 5, 1989, PR Newswire, 1 page.*

Larry Barto et al, "Behind the Scenes: How Georgia Power Electrified", Transmission & Distribution World, Mar. 1997; v49, n3, p. 18-28.*

International Search Report (PCT/ISA/210) issued on Apr. 7, 2009, by Japanese Patent Office as the International Searching Authority for International Application No. PCT/JP2009/053984.

Written Opinion (PCT/ISA/237) issued on Apr. 7, 2009, by Japanese Patent Office as the International Searching Authority for International Application No. PCT/JP2009/053984, No English Translation.

First Office Action from the Chinese Patent Office dated Nov. 1, 2012, issued in corresponding Chinese Patent Application No. 200980130770.5, with English translation thereof.

Office Action from the Japan Patent Office dated Jun. 25, 2013, issued in corresponding Japanese Patent Application No. 2010-530826, with English translation thereof. (4 pages).

Office Action from European Patent Office dated Mar. 21, 2013, issued in corresponding European Application No. 09 802 752.7, with English translation thereof (5 pages).

* cited by examiner

INFORMATION DELIVERY SERVICE SYSTEM, IN-TRAIN INFORMATION DELIVERY METHOD, AND IN-TRAIN INFORMATION DISPLAY APPARATUS

TECHNICAL FIELD

The present invention relates to an information delivery service system, an in-train information delivery method, and an in-train information display apparatus.

BACKGROUND ART

An information delivery service for delivering passengers train information and various types of information using display apparatuses installed in train vehicles of a train is developing in recent years. In Patent Document 1 mentioned below, an image to be displayed on a display apparatus is decomposed into contents, which are in level of parts, so that one content can be used on a plurality of screens. This enables to reduce the capacity of a storage unit that stores image information therein, and when one screen is modified, only a part of the content can be modified. In Patent Document 2 mentioned below, two display apparatuses are installed, as they are aligned above doors of a vehicle, so that one display apparatus displays train information regarding the travel of the vehicle, and the other display apparatus displays general information such as advertisement to deliver information to passengers.

Patent Document 1: Japanese Patent No. 3875950

Patent Document 2: Japanese Patent Application Laid-open No. 2004-70254

DISCLOSURE OF INVENTION

Problem to be Solved by the Invention

However, the invention described in Patent Document 1 mentioned above is guidance display in character information, and thus the displayable amount of information is limited. Furthermore, because the display apparatus described in Patent Document 2 mentioned above is installed above doors, there is a limitation in the installable size of the display apparatus. Furthermore, in conventional display apparatuses used for information delivery service, because each display apparatus individually performs information display, it is difficult to display many pieces of information simultaneously.

The present invention has been achieved under such circumstances, and an object of the present invention is to provide an information delivery service system that can display many pieces of information simultaneously.

Means for Solving Problem

An information delivery service system according to an aspect of the present invention is applied to a passenger train and displays an image for delivering information to passengers, the system including: an in-train information display apparatus that groups a plurality of windows of the passenger train and uses the grouped windows as one display area; and a display information processor that outputs image information to the in-train information display apparatus.

Effect of the Invention

According to the information delivery service system of the present invention, because a plurality of windows horizontally arranged on a side of a train are grouped and used as one display area, an image can be displayed on a horizontally long and large screen and many pieces of information can be delivered simultaneously.

EXPLANATIONS OF LETTERS OR NUMERALS

Figure 1:
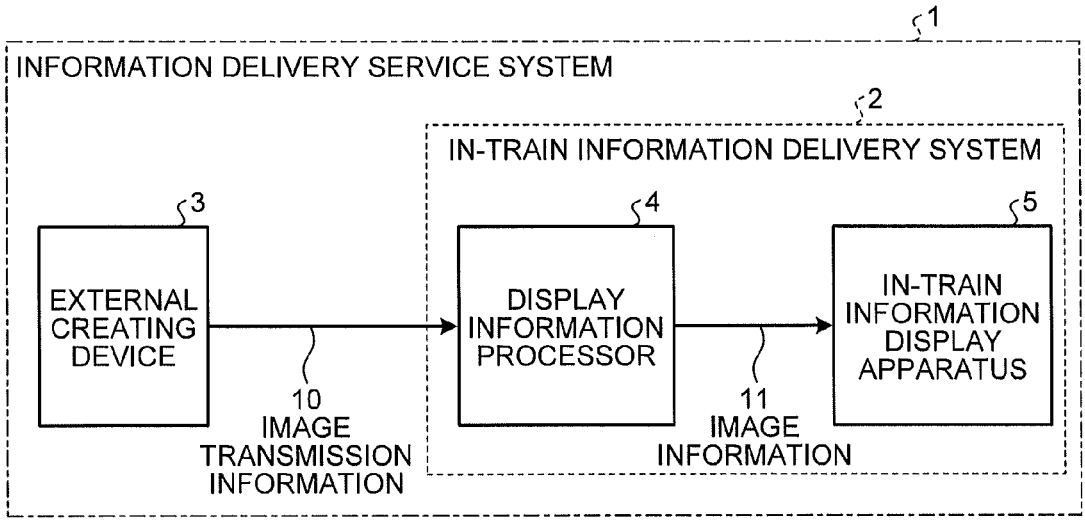
FIG. 1 is a configuration example of an information delivery service system according to the present invention.

1 Information delivery service system
2 In-train information delivery system
3 External creating device
4 Display information processor
5 In-train information display apparatus (display unit)
6 Image-information storing/reproducing unit
7 Vehicle-information monitoring device
8 Operation control panel
10 Image transmission information
11 Image information
12 Train's current-position information
13 Lead-vehicle identifying information
14 Next-station arrival platform information
20 Window
21 Display area
30 Content image information
31 Common content-image folder
32 Vehicle content-image folder
40 Next-station-yard guidance information
41 Content-display-position information folder
42 Next-station-yard guidance-display-starting-point information folder
43 Content-display-position information file
44*a*, 44*b*, 44*c* Vehicle content-display-position information file
45 Next-station-yard guidance-display-starting-point information
50, 56 Platform
51, 57 Stairs
52 Elevator
53 Direction display
54 Vehicle stop-position display
55 Transfer guidance display

BEST MODE(S) FOR CARRYING OUT THE INVENTION

An exemplary embodiment of an information delivery service system according to the present invention will be explained below in detail with reference to the accompanying drawings. The present invention is not limited to the following embodiment.

Embodiment

FIG. 1 is a configuration example of an information delivery service system 1 according to the present invention. As shown in FIG. 1, the information delivery service system 1 according to the present invention includes an external creating device 3 and an in-train information delivery system 2.

The external creating device 3 is a video editing system installed outside of a train. The external creating device 3 creates image transmission information 10, and outputs the information through a predetermined transmission method.

The transmission method for the image transmission information 10 can be a wireless transmission method using radio waves such as satellite waves or ground waves, or a wired transmission method using a fixed line such as a coaxial cable, a twisted pair cable, or an optical cable.

The in-train information delivery system 2 is installed in a train and includes a display information processor 4 and an in-train information display apparatus 5. The display information processor 4 includes a CPU that processes display information, inputs and stores the image transmission information 10 output from the external creating device 3 in advance, and outputs image information 11. The in-train information display apparatus 5 inputs the image information 11 and displays an image for delivering information to passengers.

Figure 2:
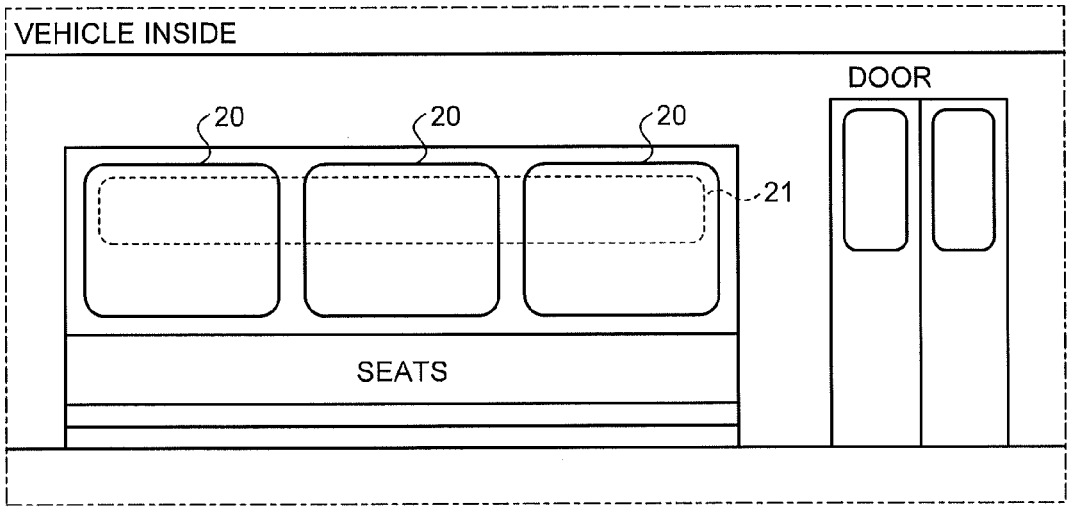
FIG. 2 is an example of a case in which an in-train information display apparatus according to an embodiment of the present invention is applied to windows.

The in-train information display apparatus 5 according to an embodiment of the present invention is explained. FIG. 2 is an example of a case in which the in-train information display apparatus 5 according to the present embodiment is applied to windows 20. In the example shown in FIG. 2, a plurality of windows 20 horizontally arranged on a side of a train are grouped and used as one display area 21. The configuration of the in-train information display apparatus 5 applied to the display area 21 can be any of a liquid crystal panel, an organic EL panel and the like. An LCD, an organic EL panel, or so-called electronic paper (suitable when the wall surface is curved) is installed on a horizontally long wall surface of a vehicle body above the windows can be used as the display area 21.

Figure 3:
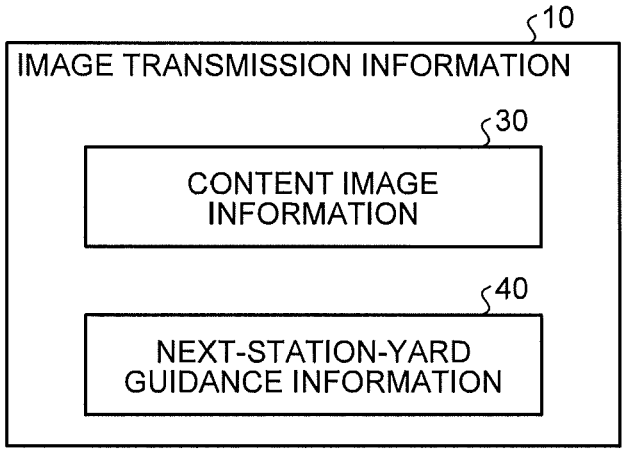
FIG. 3 is a configuration example of image transmission information according to the embodiment.

A configuration of the image transmission information 10 according to the present embodiment is explained next with reference to FIG. 3. FIG. 3 is a configuration example of the image transmission information 10 according to the present embodiment. In the present embodiment, before a traveling train arrives at the next station, information of a platform of the next station is provided to passengers. The image transmission information 10 includes content image information 30 and next-station-yard guidance information 40. The content image information 30 includes content image files, which are in level of parts, the parts being respectively corresponding to facility information of station platforms, stairs, and elevators, transfer guidance display information of the station yard, and stop position information of vehicles. Further, the next-station-yard guidance information 40 includes content display-position information indicating a display position of a content image on the next-station-yard guidance image for each station and information of a next-station-yard guidance-display starting point. The content image, which is in a part level, is similar to the content part described in Patent Document 1, for example.

Figure 4:
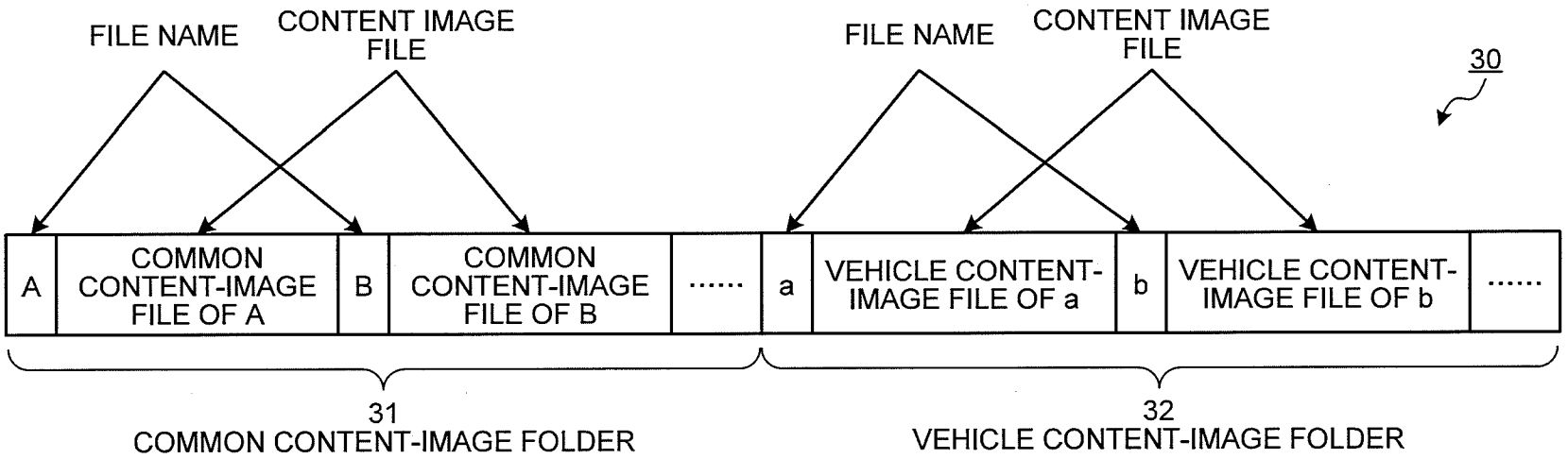
FIG. 4 is a configuration example of content image information.

FIG. 4 is a configuration example of the content image information 30. The content image information 30 includes a common content-image folder 31 and a vehicle content-image folder 32. The common content-image folder 31 includes a plurality of content image files common to respective train vehicles and file names of the respective common content-image files. The vehicle content-image folder 32 includes a plurality of vehicle content-image files different for each vehicle, and file names of the respective vehicle content-image files.

Figure 5:
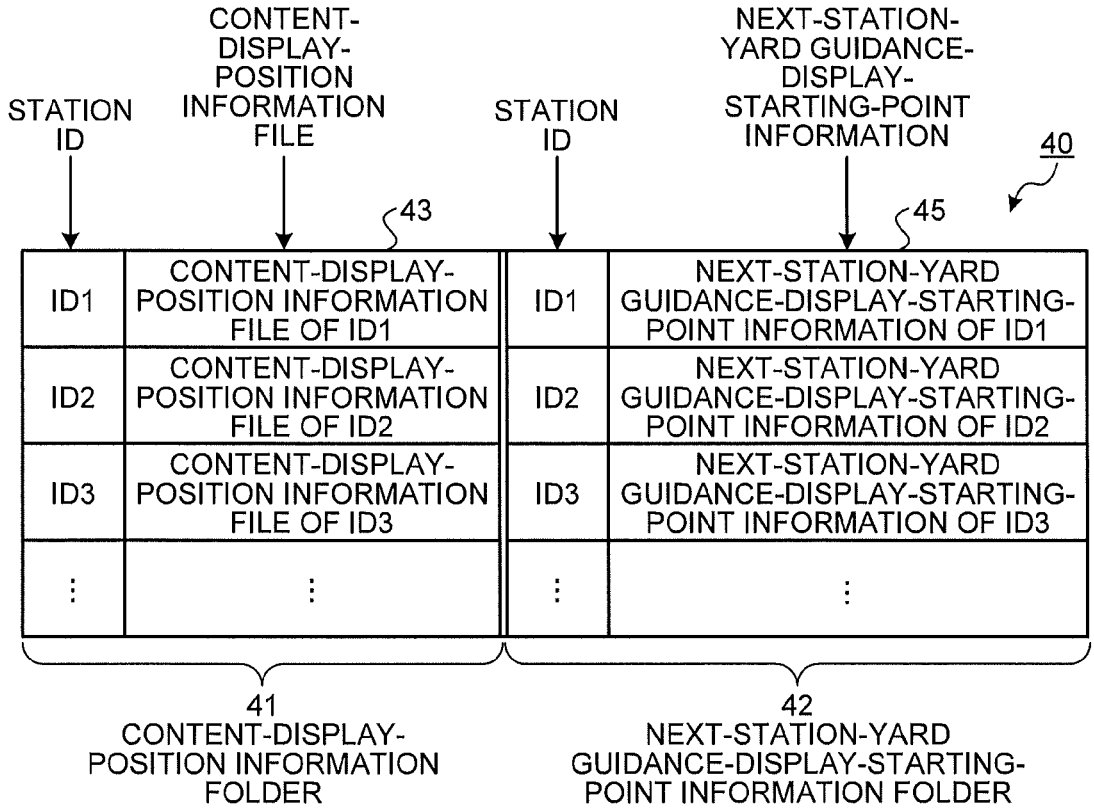
FIG. 5 is a configuration example of next-station-yard guidance information.

FIG. 5 is a configuration example of the next-station-yard guidance information 40. As shown in FIG. 5, the next-station-yard guidance information 40 includes a content-display-position information folder 41 and a next-station-yard guidance-display-starting-point information folder 42. The content-display-position information folder 41 includes station IDs allocated to respective stations and a plurality of content-display-position information files 43 associated with respective station IDs.

Figure 6:
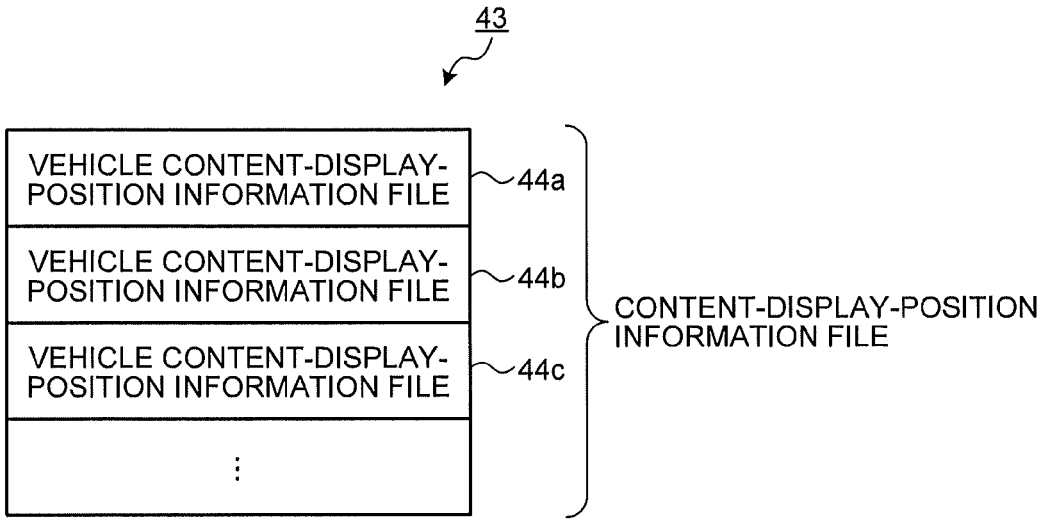
FIG. 6 is a configuration example of a content-display-position information folder.

FIG. 6 is a configuration example of the content-display-position information file 43. As shown in FIG. 6, the content-display-position information file 43 includes a plurality of vehicle content-display-position information files 44 different for each vehicle of a train. The next-station-yard guidance-display-starting-point information folder 42 includes station IDs and pieces of next-station-yard guidance-display-starting-point information 45 each of which specifies a point for starting next-station-yard guidance display based on the content-display-position information file 43 associated with the each station ID.

Figure 7:
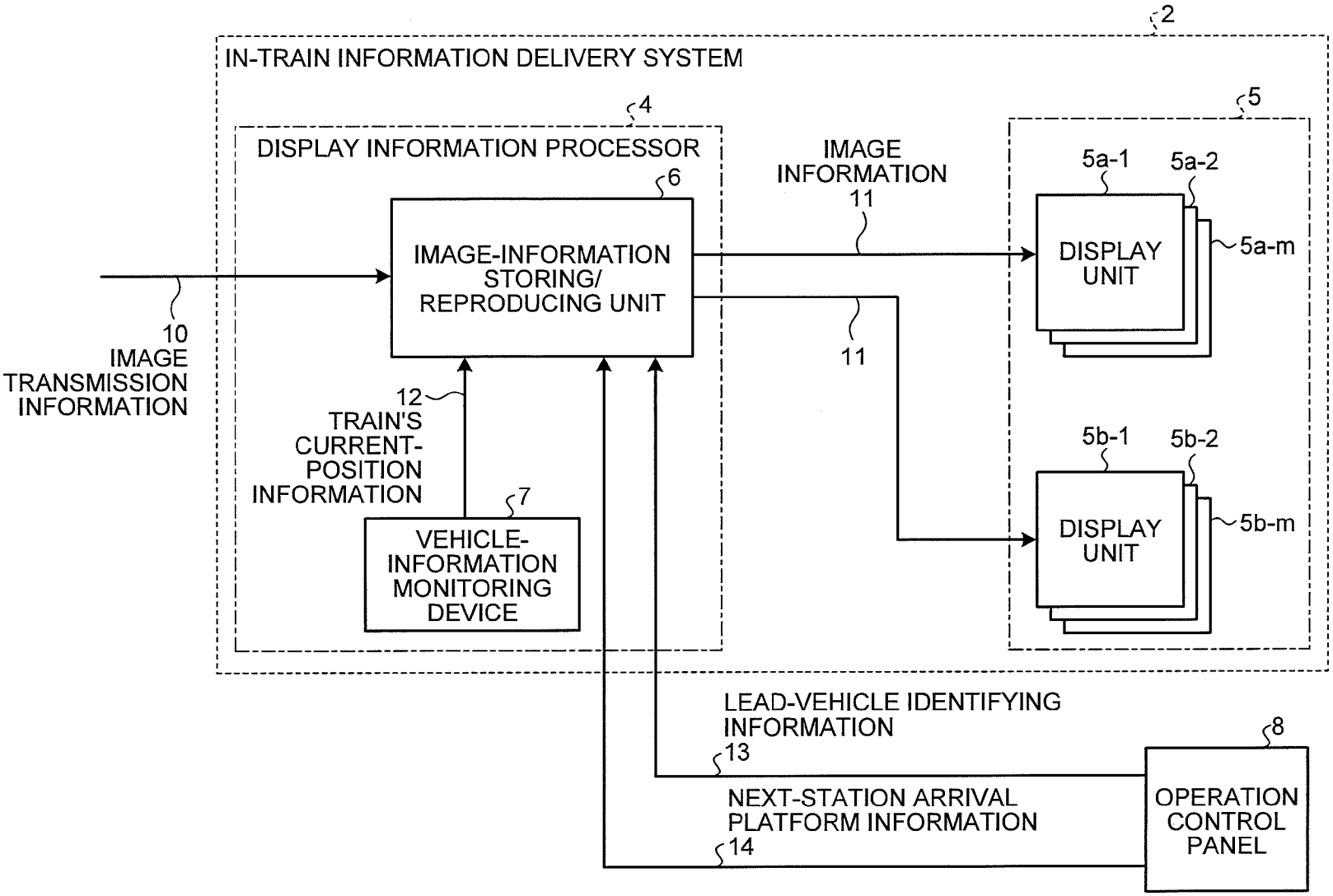
FIG. 7 is a block diagram of an example of a configuration of an in-train information delivery system according to the embodiment.

A configuration of the in-train information delivery system 2 and input/output signals of the respective elements are explained next with reference to FIG. 7. FIG. 7 is a block diagram of an example of a configuration of the in-train information delivery system 2 according to the present embodiment.

The in-train information delivery system 2 includes the display information processor 4 including an image-information storing/reproducing unit 6 and a vehicle-information monitoring device 7, and a plurality of display units 5*a* and 5*b* forming the in-train information display apparatus 5. Each of the display unit 5*a* and the display unit 5*b* corresponds to one side of a vehicle. Display units 5*a*-1 to 5*a*-*m* and display units 5*b*-1 to 5*b*-*m* correspond to the first vehicle to the mth vehicle, respectively.

The vehicle-information monitoring device 7 always monitors a position where the train is currently traveling based on train position information and the like indicating a distance (kilometers) from a departing station and the like. The vehicle-information monitoring device 7 generates and outputs train's current-position information 12 indicating point information of the current traveling position of the train. The vehicle-information monitoring device 7 can be formed using a GPS and the like.

The image-information storing/reproducing unit 6 specifies an arrival platform of the train in the next station, the side of a vehicle facing the platform, and stop positions of the respective vehicles forming the train with respect to the platform, based on lead-vehicle identifying information 13 and next-station arrival platform information 14 output from an operation control panel 8.

When the next-station-yard guidance-display-starting-point information 45 in the next-station-yard guidance-display-starting-point information folder 42 included in the next-station-yard guidance information 40 matches the train's current-position information 12, the image-information storing/reproducing unit 6 outputs image information 11 to the display units 5*a* and 5*b* arranged on the windows 20 on the side facing the arrival platform.

Figure 8:
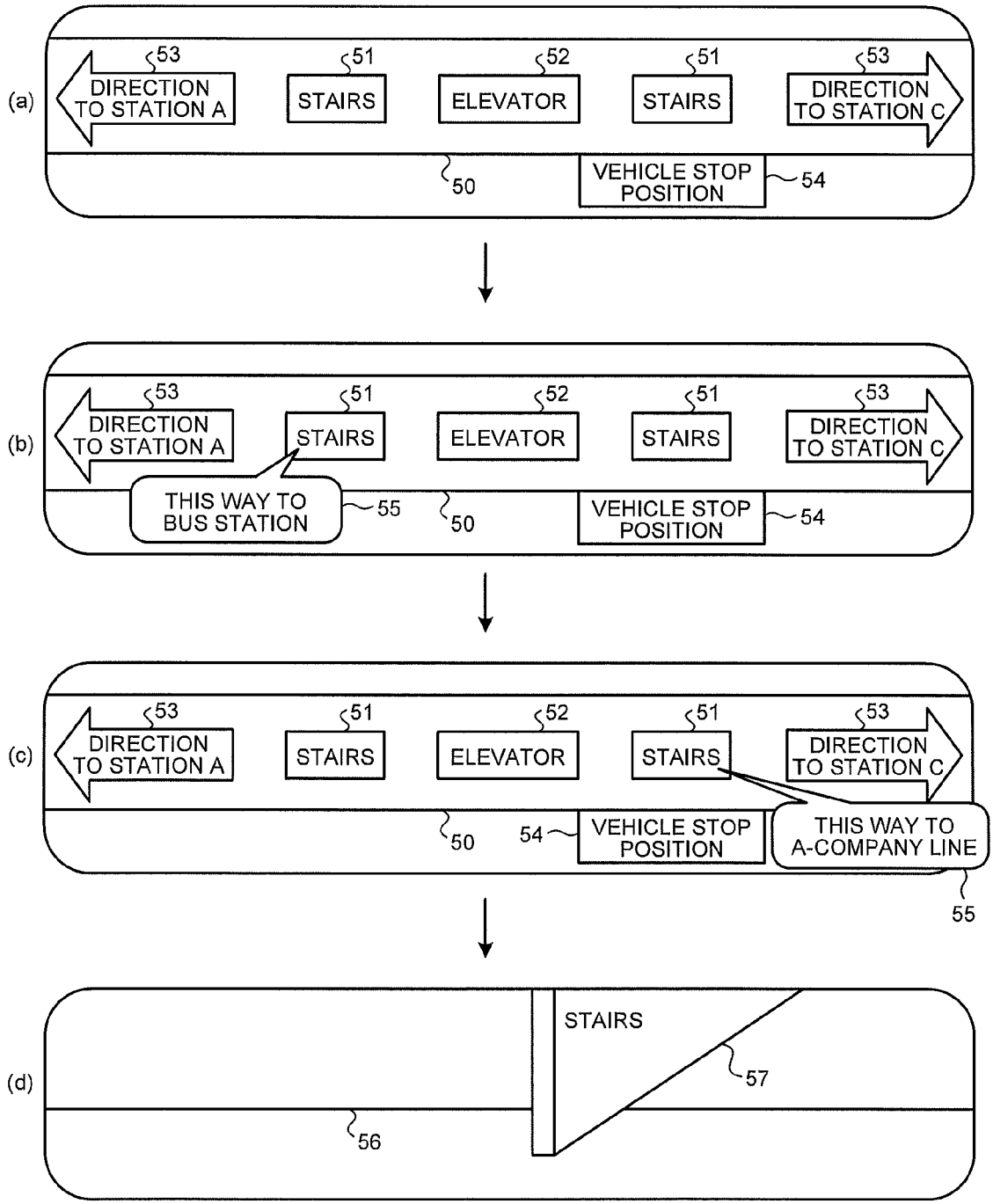
FIG. 8 depict a display transition of a next-station-yard guidance image.

Display of a next-station-yard guidance image is explained next with reference to FIG. 8. FIG. 8 depict a display transition of a next-station-yard guidance image. For example, the next-station-yard guidance image is displayed as shown in the order of (a), (b), (c), and (d) in FIG. 8. FIG. 8(*a*) displays information of the entire arrival platform of the train in the next station. FIGS. 8(*b*) and 8(*c*) display transfer guidance information after exiting the train. FIG. 8(*d*) displays facility information of the platform, which is information for each position where each vehicle stops.

In the next-station-yard guidance images of FIG. 8, a platform 50, stairs 51, an elevator 52, direction displays 53, and a transfer guidance display 55 are common content images forming a display common to the respective vehicles. The common content images are generated from common content-image files included in the common content-image folder 31 in FIG. 4.

A vehicle stop-position display 54, a platform 56, and stairs 57 are vehicle content images constituting a display different for each vehicle. The vehicle content image is generated from the vehicle-content image file included in the vehicle content-image folder 32 in FIG. 4.

That is, FIGS. 8(*a*) to 8(*c*) are displays formed by superposing the content image in the vehicle stop-position display 54, which is the vehicle content image different for each vehicle, on the display constituted by the common content image common to respective vehicles, and FIG. 8(*d*) is a display constituted only of the vehicle content image different for each vehicle.

An operation of the in-train information delivery system 2 for delivering a next-station-yard guidance image to passengers is explained next in detail with reference to FIGS. 4, 5, 6, 7, and 8.

In FIG. 7, before servicing of a train, the image-information storing/reproducing unit 6, into which the image transmission information 10 is input, stores therein the content image information 30 in FIG. 4 and the next-station-yard guidance information 40 in FIG. 5.

While the train is traveling, the vehicle-information monitoring device 7 outputs the train's current-position information 12 on a real-time basis. The image-information storing/reproducing unit 6, into which the train's current-position information 12 is input, compares the train's current-position information 12 with the next-station-yard guidance-display-starting-point information 45 included in the next-station-yard guidance information 40. As the next-station-yard guidance-display starting point, a predetermined time is obtained in advance from an arrival time of the train at the next station by an inverse operation, to set a point where the train passes through at that time.

The lead-vehicle identifying information 13 and the next-station arrival platform information 14 are input to the image-information storing/reproducing unit 6 from the operation control panel 8, so that the image-information storing/reproducing unit 6 specifies an arrival platform of the train in the next station, the side of the vehicle facing the platform, and stop positions of the respective vehicles forming the train with respect to the platform. When the train approaches the next station and the next-station-yard guidance-display-starting-point information 45 included in the next-station-yard guidance information 40 matches the train's current-position information 12, the next station-yard guidance is started to be displayed. That is, delivery of the next-station-yard guidance image is started at the predetermined time, which is obtained from the time when the train will arrive at the next station by an inverse operation. More specifically, when the next-station-yard guidance-display-starting-point information 45 matches the train's current-position information 12, the image-information storing/reproducing unit 6 extracts a content image file from the common content-image folder 31 and the vehicle content-image folder 32 in FIG. 4, based on the vehicle content-display-position information file 44 in FIG. 6 included in the content-display-position information files 43 associated with the station ID in FIG. 5. Then, the image-information storing/reproducing unit 6 generates the next-station-yard guidance images shown in FIGS. 8(*a*) to 8(*d*) for each vehicle and outputs the image information 11, which is the next-station-yard guidance image shown in FIG. 8(*a*), to the display units 5*a* and 5*b* in each of the vehicles arranged on the windows 20 on the side facing the arrival platform.

Thereafter, the image-information storing/reproducing unit 6 changes the next-station-yard guidance image from that shown FIG. 8(*a*) to that shown in FIGS. 8(*b*), 8(*c*), and 8(*d*), each time a certain period of time has passed, to switch the image to the display shown in FIG. 8(*d*) before the train arrives at the next station. The image-information storing/reproducing unit 6 finishes the display of the next-station-yard guidance image according to the time when the train arrives at the next station.

As described above, according to the information delivery service system of the embodiment of the present invention, because a plurality of windows horizontally arranged on the side of the train are grouped and used as one display area, an image can be displayed on a horizontally long and large screen, and many pieces of information can be delivered simultaneously.

Further, because an image can be displayed on a horizontally long and large screen, the information delivery service system is suitable for delivering information such as the position of stairs and the like on the station platform and the stop position of the vehicle with respect to the platform. Because the image information processed by the display information processor 4 is the next-station-yard guidance image information, and the next-station-yard guidance information is delivered before the train arrives at the next station, passengers can confirm the positional relation between the stop positions of their vehicles and the stairs or elevator on the platform. Accordingly, passengers can know the shortest route in advance corresponding to transfer after exiting the train or to the destination, and can move to a most appropriate exiting position (vehicle) to exit the train.

According to the in-train information delivery method of the present embodiment, when image information processing for outputting information of the arrival station of the train to the in-train information display unit 5 is performed, a current traveling position of the train is detected to output the train's current position information. The arrival platform for the train in the next station, the side of the vehicle that faces the platform, and stop positions of the respective vehicles forming the train on the platform are specified based on the lead-vehicle identifying signal and the next-station arrival platform information output from an operation control panel. The content image information including a plurality of content image files, which are in level of parts, the parts being corresponding to respective the facility information of the station platform, the guidance information of the yard, and the stop position information of the vehicle are stored. Furthermore, the next-station-yard guidance information including the content display-position information in the content image file in stations present in the train operation route, and the information of the next-station-yard guidance-display starting point, which is corresponding to the content display-position information, are stored. The train's current-position information is compared with the information of the next-station-yard guidance-display starting point. When the train's current-position information matches the information of the next-station-yard guidance-display starting point, a necessary content image file is extracted from the content image information based on the content display-position information, to generate and reproduce the next-station-yard guidance image information. Accordingly, passengers can know the shortest route in advance suited to transfer after exiting the train or the destination, and can move to the most appropriate exiting position (vehicle) to exit the train.

For example, in the above embodiment, the display information processor 4 including a CPU can be provided at a separate predetermined place in the vehicle away from the display units 5*a-m* and 5*b-m* (such as at a corner of an aisle, under a seat, or under a floor) and can be connected to the respective display units 5*a-m* and 5*b-m* by a cable. In this case, only the display units 5*a-m* and 5*b-m* are installed to the window, and this gives flexibility in installation layout of the window, and thus a wide space can be taken for the window, for example.

Furthermore, for example, the image-information storing/reproducing unit 6 including a CPU can be provided individually to each of the respective display units 5*a-m* and 5*b-m*. In this case, the image-information storing/reproducing unit 6 can be provided near each of the display units 5*a-m* and 5*b-m*, or the image-information storing/reproducing unit 6 can be integrated with each of the respective display units 5*a-m* and 5*b-m* (a display unit having a display information processing CPU incorporated therein). With this arrangement, detailed guidance information can be displayed on the display units 5*a-m* and 5*b-m* installed, for example, in a women-only vehicle or a smoking vehicle, such that it is possible to display guidance information helpful to passengers in the specific vehicle, which is different from guidance information in other vehicles.

INDUSTRIAL APPLICABILITY

As described above, the information delivery service system, the in-train information delivery method, and the in-train information display apparatus according to the present invention are useful as an invention that can deliver many pieces of information simultaneously in railway vehicles.

The invention claimed is:

1. An information delivery service system that is applied to a passenger train and displays an image for delivering information to passengers, the system comprising:

an in-train information display apparatus that groups a plurality of windows of the passenger train and uses the grouped windows as one display area; and a display information processor that outputs image information to the in-train information display apparatus, wherein the display information processor outputs information of a next-station-yard guidance image, which is guidance image information of a station yard where the train arrives, as the image information, and the display information processor includes:

a vehicle-information monitoring device that detects a current traveling position of a train and outputs train's current-position information; and an image-information storing/reproducing unit that specifies an arrival platform for the train in the next station, a side of a vehicle that faces the platform, and stop positions of respective vehicles forming the train on the platform based on a lead-vehicle identifying signal output from an operation control panel and arrival platform information of the next station, stores content image information including a plurality of content image files, which are in level of parts, the parts being respectively corresponding to facility information of a station platform, guidance information of a station yard, and stop position information of vehicles, and next-station-yard guidance information including content display-position information of the content image file in stations present in a train operation route, and information of a next-station-yard guidance-display starting point corresponding to the content display-position information, compares the train's current-position information with the information of the next-station-yard guidance-display starting point, and when the train's current-position information matches the information of the next-station-yard guidance-display starting point, extracts a necessary content image file from the content image information based on the content display-position information, to generate and reproduce next-station-yard guidance image information.

2. The information delivery service system according to claim 1, wherein the content display-position information includes a plurality of pieces of vehicle content display-position information being different for each vehicle of a train, and the image-information storing/reproducing unit generates the next-station-yard guidance image information for each vehicle based on the vehicle content display-position information.

3. The information delivery service system according to claim 2, wherein the content image information includes a plurality of common content-image files common to all vehicles of a train and a plurality of vehicle content-image files being different for each vehicle, and the image-information storing/reproducing unit generates the next-station-yard guidance image information for each vehicle by superposing an image formed of the vehicle content-image file on an image formed of the common content-image file.

4. An in-train information display apparatus applied to the information delivery service system according to claim 3, wherein a plurality of windows of the passenger train are grouped and used as one display area.

5. An in-train information display apparatus applied to the information delivery service system according to claim 3, wherein a horizontally long wall surface of a vehicle body above windows of the passenger train is used as a part of the one display area.

6. An in-train information display apparatus applied to the information delivery service system according to claim 2, wherein a plurality of windows of the passenger train are grouped and used as one display area.

7. An in-train information display apparatus applied to the information delivery service system according to claim 2, wherein a horizontally long wall surface of a vehicle body above windows of the passenger train is used as a part of the one display area.

8. An in-train information display apparatus applied to the information delivery service system according to claim 1, wherein a plurality of windows of the passenger train are grouped and used as one display area.

9. An in-train information display apparatus applied to the information delivery service system according to claim 1, wherein a horizontally long wall surface of a vehicle body above windows of the passenger train is used as a part of the one display area.

10. An in-train information delivery method using a display apparatus that groups a plurality of windows of a passenger train and uses the grouped windows as one display area or using a display apparatus that uses a horizontally long wall surface of a vehicle body above windows as one display area, and comprising a display information outputting step of outputting information of station platform where a train arrives to the display apparatus, wherein the display information outputting step includes:

a vehicle-information monitoring step of detecting a current traveling position of a train and outputting train's current-position information;

a specifying step of specifying an arrival platform for the train in the next station, a side of a vehicle that faces the platform, and stop positions of respective vehicles forming the train on the platform, based on a lead-vehicle identifying signal output from an operation control panel and arrival platform information of the next station;

an image information storing step of storing content image information including a plurality of content image files, which are in level of parts, the parts being respectively corresponding to facility information of a station platform, guidance information of a station yard, and stop position information of a vehicle, and next-station-yard guidance information including content display-position information of the content image file in stations present in a train operation route, and information of a next-station-yard guidance-display starting point corresponding to the content display-position information; and an image information reproducing step of comparing the train's current-position information with the information of the next-station-yard guidance-display starting point, and when the train's current-position information matches the information of the next-station-yard guidance-display starting point, extracting a necessary content image file from the content image information based on the content display-position information, and generating and reproducing next-station-yard guidance image information.

* * * * *